US006711758B1

(12) United States Patent
Terek et al.

(10) Patent No.: US 6,711,758 B1
(45) Date of Patent: Mar. 30, 2004

(54) SELF-CONTAINED EMERGENCY SHOWER AND EYEWASH SYSTEM

(75) Inventors: Johnny Joseph Terek, Butzbach (DE); David Glenn Grassmyer, Luen (DE)

(73) Assignee: Army & Air Force Exchange Service, Dallas, TX (US)

( * ) Notice: Subject to any disclaimer, the term of this patent is extended or adjusted under 35 U.S.C. 154(b) by 0 days.

(21) Appl. No.: 10/436,607

(22) Filed: May 8, 2003

(51) Int. Cl.[7] ..... A61H 33/00; A61H 33/04

(52) U.S. Cl. ..... 4/620; 4/617

(58) Field of Search ..... 4/615, 617, 619–621; 239/16, 128

(56) References Cited

U.S. PATENT DOCUMENTS

| | | | | | |
|---|---|---|---|---|---|
| 716,096 | A | * | 12/1902 | Pierce | 4/617 |
| 3,962,733 | A | * | 6/1976 | Parry | 4/615 |
| 5,331,694 | A | * | 7/1994 | Mackenzie et al. | 4/620 |
| 6,070,279 | A | * | 6/2000 | Lundstedt | 4/620 |

* cited by examiner

*Primary Examiner*—Tuan N. Nguyen
(74) *Attorney, Agent, or Firm*—Luis M. Ortiz; Kermit D. Lopez

(57) ABSTRACT

A conventional, full-scale emergency shower and eyewash unit uniquely retrofitted for use in work areas where water is not easily provided. An emergency shower and eyewash unit can be retrofitted at piping located near its top to be in fluid communication with a large capacity container suitable for containing liquid and located above the top of the shower/eyewash unit so that fluid (i.e., water) contained therein can flow into the shower/eyewash unit using the benefit of gravity. Additionally, a liquid release valve can be located near the base/bottom of the shower/eyewash unit so that liquid contained in the container can periodically be released during routine maintenance and cleaning. Conditioning means are also described ensures that fluid/water contained in the container is not allowed to become harmful through bacterial or microorganism growth, which is common in stagnant liquids such as water, and to maintain liquid temperature. Also described are means for powering and controlling hardware used to condition liquid stored in a container for use with the present system.

24 Claims, 5 Drawing Sheets

SELF-CONTAINED EMERGENCY SHOWER AND EYEWASH SYSTEM

TECHNICAL FIELD OF THE INVENTION

The present invention generally relates to industrial and commercial emergency equipment. More particularly, the present invention relates to emergency shower and eyewash system.

BACKGROUND

Conventional emergency showers and eyewash systems are typically designed by safety equipment manufactures to be hooked up to running water sources located within manufacturing, industrial, and research facilities. Many facilities, however, are limited with respect to having running plumbing throughout all work areas requiring full-scale emergency water flushing equipment. Adding the necessary plumbing throughout warehouses lacking suitable water sources for conventional, full-scale equipment could, furthermore, be costly. As a result of infrastructure limitations associated with plumbing, portable devices are typically deployed throughout facilities to accommodate industrial safety requirements and guidelines. Most portable units, however, are also limited as compared to full-scale equipment in the ability to adequately deliver fluid pressure and quantity. Portable units generally lack storage capacity, may require electrical pump assistance to overcome poor gravity performance, and are not as easy to locate and operate as conventional utility-plumbed systems (i.e., connected to a facility water and sewer system).

Employee safety procedures and equipment use is mandated in most industrialized countries. In the United States, for example, emergency shower and eyewash unit guidelines are provided in 29 CFR 1910.151(c)—(ANSI Z358.1-1998), Emergency shower and eyewash equipment. According to the ANSI standard, emergency shower, eyewash and face washing units must be located nor more than 10 seconds from potential hazards. The units must be on same level as the hazard and the path of travel shall be free of obstructions that inhibit the immediate use of the equipment. The unit's location must be in a well-lit area and identified with a sign. All units must include valves that can activate in 1 second or less and stay open during use until turned off by a user.

More technical specifications directly associated with each type of emergency washing/flushing units are outlined in the ANSI standard. A utility-plumbed unit is permanently connected to a source of potable water and a self-contained unit contains its own flushing fluid that must be refilled or replaced after use. Emergency shower heads must be positioned no less than about 82" from the floor, have a spray pattern a minimum diameter of 20" at 60" above the floor, have a flow rate of 20 gallons per minute at a velocity low enough to be non-injurious to the user, and the center of the spray pattern should be located at least 16" from any obstruction.

Eye and face wash units are devices used to irrigate and flush both the face and eyes. Eyewash units should be protected from airborne contaminants and must be positioned about 33" to 45" from the floor and 6" from walls or nearby obstructions. The units should have large enough heads to cover both of a user's eyes and the user's face or combine regular size eye wash heads with a face spray ring. Combined eyewash and facewash units should be capable of delivering 3 gallons per minute (GPM) for 15 minutes. Eyewash units should be capable of delivering 0.4 gallons per minute (GPM) for 15 minutes for gravity-feed units.

The present inventors have recognized through their experience in industrial settings that a need exists for cost effective deployment of combined emergency shower and eyewash/facewash systems throughout potentially hazardous industrial, manufacturing or research facilities without restriction or concern associated with the lack of available water supplies and plumbing. Yet, the present inventors also recognize the need for enterprises to economize and use commonly available resources when available. With this in mind, the present inventors believe that their invention can address the current need and resolve problems facing safety- and compliance-minded companies and organizations without departing substantially from the use of emergency washing equipment that is already widely known and accepted by industry.

SUMMARY OF THE INVENTION

To address the industrial need to overcome limitations found to be present in the industrial safety field, the present invention is herein disclosed by the present inventors in hopes of providing a emergency washing systems for use in areas within facilities requiring such safety equipment but lacking the necessary plumbing or utilities to deliver water typically required for full-scale, permanently located emergency flushing requirements.

In accordance with one aspect of the present invention, a full-scale emergency washing system for use in areas within facilities lacking plumbing or utilities necessary to deliver water.

In accordance with another aspect of the present invention, new improvement can be provided as useful a retrofit for and modification to full-scale, conventional and generally available emergency washing equipment.

In accordance yet another aspect of the present invention, to provide a system that can provide quantities and operations that meet regulations, guidelines or rules governing full-scale emergency washing equipment.

In accordance with another aspect of the present invention, a system can be provided that can be located conveniently throughout a facility in a manner that facilitates its identification and use.

In accordance with general features of the present invention, a conventional (e.g., full-scale) emergency shower and/or eyewash unit can be retrofitted for use in work areas where water is not available or easily provided. A typical, full-scale emergency shower and/or eyewash unit can be retrofitted at plumbing connection located near the top of its main delivery pipe to be in fluid communication with a large capacity container capable of large amounts of fluid storage and located well above the shower/eyewash unit so that fluid (i.e., water) from the container can flow into the shower/eyewash unit using the benefit of gravity. Additionally, a liquid release valve can be located near the base/bottom of the shower/eyewash unit so that liquid contained in the container can periodically be released during routine system maintenance, cleaning, and bleeding (e.g., the process of purging air from system pipes).

Alternate configurations can be included for use within the emergency washing system to ensures that fluid/water contained in the container is not allowed to itself become harmful from bacterial or microorganism growth, which is a common problem with stagnant liquids such as water. For example, an air pump can be added to the container in order to supply a constant fresh air supply to the (standing) water supply. An air release valve can also be added onto the top or lid of the storage container to prevent pressure from building up inside it. Additionally an electro-mechanically driven agitation device can be added inside the container to move liquid throughout the container while it is being stored and thereby assist in preventing stagnation.

Liquid temperature is sometimes difficult to maintain in work locations lacking heat. The addition of a heater to the container can help keep the liquid contained therein at a comfortable temperature for its potential use in the event of an emergency. A heater can include electrically powered heating coils submersed in the liquid containing area of the container, or heating element can be embedded in or mounted to the container housing itself. Facility, batter and solar power sources can be used to provide power to any heater or agitator that may be used with the present system. A controller can also be used to manage the heater and agitator.

The entire shower system can include the use of a metal rack that can stand alone, or be secured to the floor and the walls of the emergency washing and decontamination area. The emergency rack, supported container and washing hardware should provide an easily identifiable, accessible emergency washing station for use in environments that can sometimes be crowded with large amounts of equipment, supplies and personnel. It should be appreciated by those skilled in the art after fully appreciating the present disclosure that cost effective units can be assembled and install in multiple, water- and plumbing-deprived locations throughout industrial settings requiring their installation and potential use.

Other features and advantages of the present invention will be apparent to those of ordinary skill in the art upon reference to the following detailed description when interpreted in view of the accompanying drawings.

DESCRIPTION OF THE DRAWINGS

For a better understanding of the invention, and to show by way of example how the same may be carried into effect, reference is now made to the detailed description of the invention along with the accompanying figures in which.

DETAILED DESCRIPTION OF PREFERRED EMBODIMENTS

While the making and using of various embodiments of the present invention are discussed in detail below, it should be appreciated that the present invention provides other applicable inventive concepts, which can be embodied in a wide variety of specific contexts. The specific parts and dimensions described in embodiments disclosed herein are merely illustrative of specific ways for the skilled in the art to make and use the invention and are not meant to limit the scope of the invention.

Figure 1:
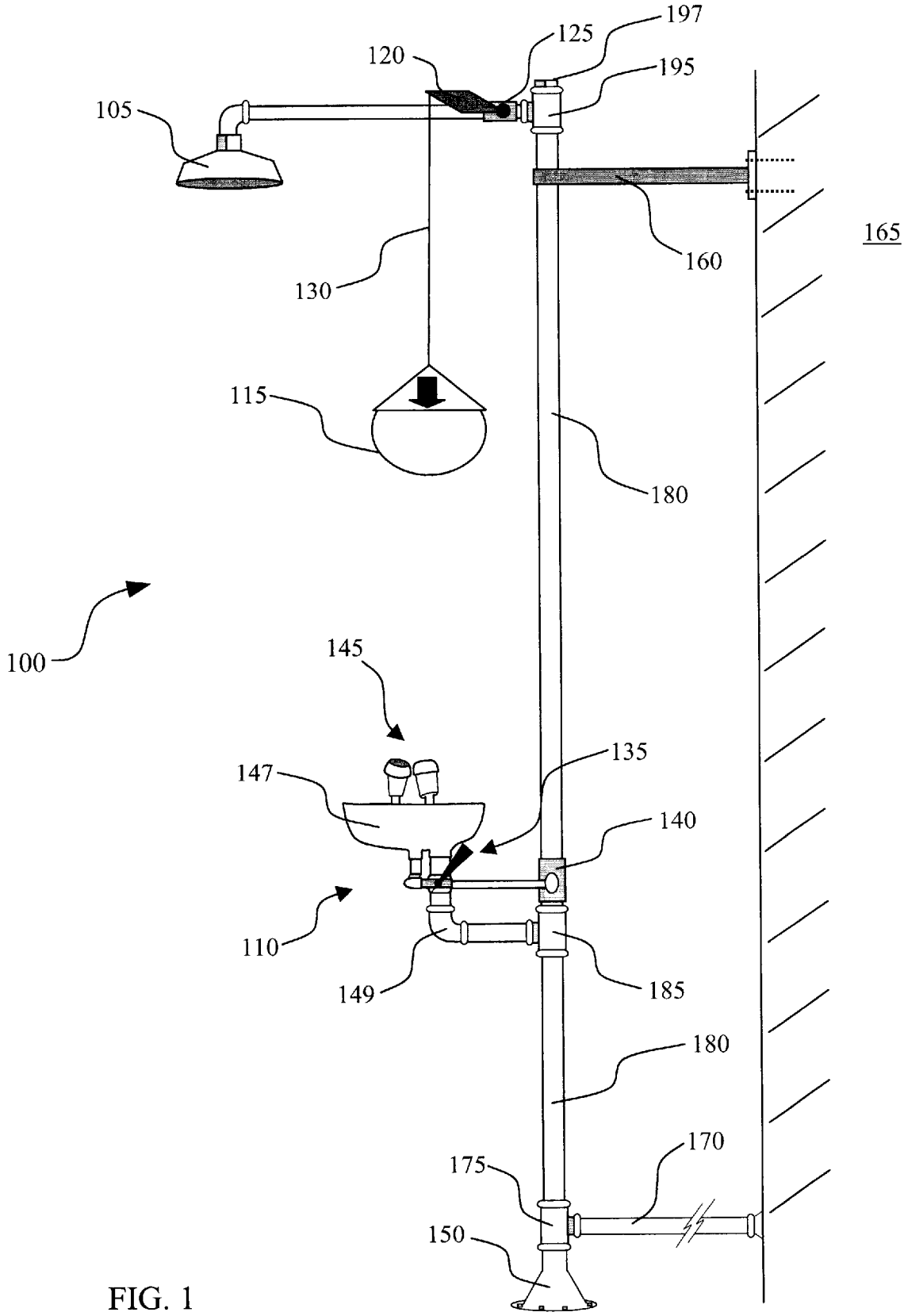
FIG. 1 (PRIOR ART)
FIG. 1 labeled as prior art, is an illustration of an emergency shower and eye wash station typically in use within industrial, manufacturing, laboratory and other potentially hazardous environments wherein use of such a system may be mandated.

Referring to FIG. 1, identified as prior art, a combined emergency shower and eyewash unit 100 commonly found in use throughout manufacturing, industrial and laboratory settings to meet industrial safety requirements is illustrated. An emergency shower and eyewash unit 100 will typically have at least one of a showerhead unit 105 or eyewash/facewash unit 110. Where a shower head unit 105 is in use, a person requiring activation of an emergency rinse can activate the valve 125 associated with causing delivery of liquid (typically water) to the shower head unit 105. The valve is normally caused to become open, allowing water to flow through the shower head unit 105 to area located directly below it, by a user pulling generally downward on an easily identifiable ring handle 115. The ring handle 115 is typically tied by a cord 130 to a lever 120, which is in operational connection with the valve 125. The ring handle is also typically brightly colored (e.g., orange, yellow and/or red) and may have a arrow clearly, simply and universally identifying the direction a user must pull on the ring to most effectively cause the shower head unit 105 to operate.

Where an eyewash/facewash unit 110 is being used, a user will typically push on an easily identifiable hand lever 135, typically presented in the form of a paddle. By pushing forward on the hand lever 135, a valve 140 associated with the hand/face wash unit 110 will open causing water to flow out of spray heads 145 that will normally be oriented so that water will spray in an upwardly direction towards a user's face and eyes. Sometimes the eye/face wash units will be activated by a foot-operated valve (not shown). A bowl 147 can be provided with eye/face wash units to catch water and cause it to drain if necessary plumbing associated with a drain is provided; otherwise, it is common to find eye/face wash units without a bowl. It is acceptable in most environments for water to be allowed to drop to the ground surrounding an emergency washing station because emergency events are hoped to be nonexistent or rare. Nevertheless, basic units capable of delivering emergency wash/rinse are the least that is required in many conditions and environments.

Delivery of water to emergency wash hardware such as the shower 105 and eye/face wash 110 units illustrated in FIG. 1 is typically provided through a main pipe section 180, to which the wash hardware 105 and 110 will be placed in liquid communication via plumbing hardware and methods well known in the art. The main pipe section 180 (shown with two locations) can be adapted for use as a combined vertical support and liquid delivery unit. The main pipe section 180 should be selected so that when it is fully assembled it extends vertically upwards about 82" or more from a base location near a floor to its upward termination point. The main pipe section 180 can further include a first plumbing connection point 175 located near the floor, a second plumbing connection point 185 located at about 33" to 45" above the floor, and a third plumbing connection point 195 located near the upward termination point. The plumbing connection points should include plumbing connections suitable for receiving standard hardware associated with emergency washing equipment such as the shower 1–5 and eye/face wash 110 units.

As shown in FIG. 1, the first plumbing connection point 175 is shown located near the bottom of the main pipe section 180 above a base 150 that may also be in use to firmly support the main pipe section 180. As shown in the illustrated environment, the first plumbing connection point can be used to connect to a water supply line 170 provided by the facility, represented by wall 165. With such a connection, the main pipe section 180 can fill with water where it can be summoned into use via ring-actuated valve 125 or paddle valve 135. Also, the second plumbing connection point can be used solely to support the eye/face wash station 110, and would therefore have to be sealed off to prevent water from flowing into a drain (not shown) that would normally be associated with drain piping 149 and the bowl 147 if in use as shown in FIG. 1. The third plumbing connection point 195 would also be capped 197 if a t-connection were being used, allowing water to flow only to the shower unit 105 and associated hardware. Furthermore, if water can be allowed to drain through the base 150, then any opening provided within the base 150 should also be sealed off. Support hardware 160 would also normally be used with a supporting connection somewhere between the second 185 and third 195 plumbing connection points to ensure that the entire structure for the emergency station 100 is firmly secured, normally to a neighboring wall 165.

Figure 2:
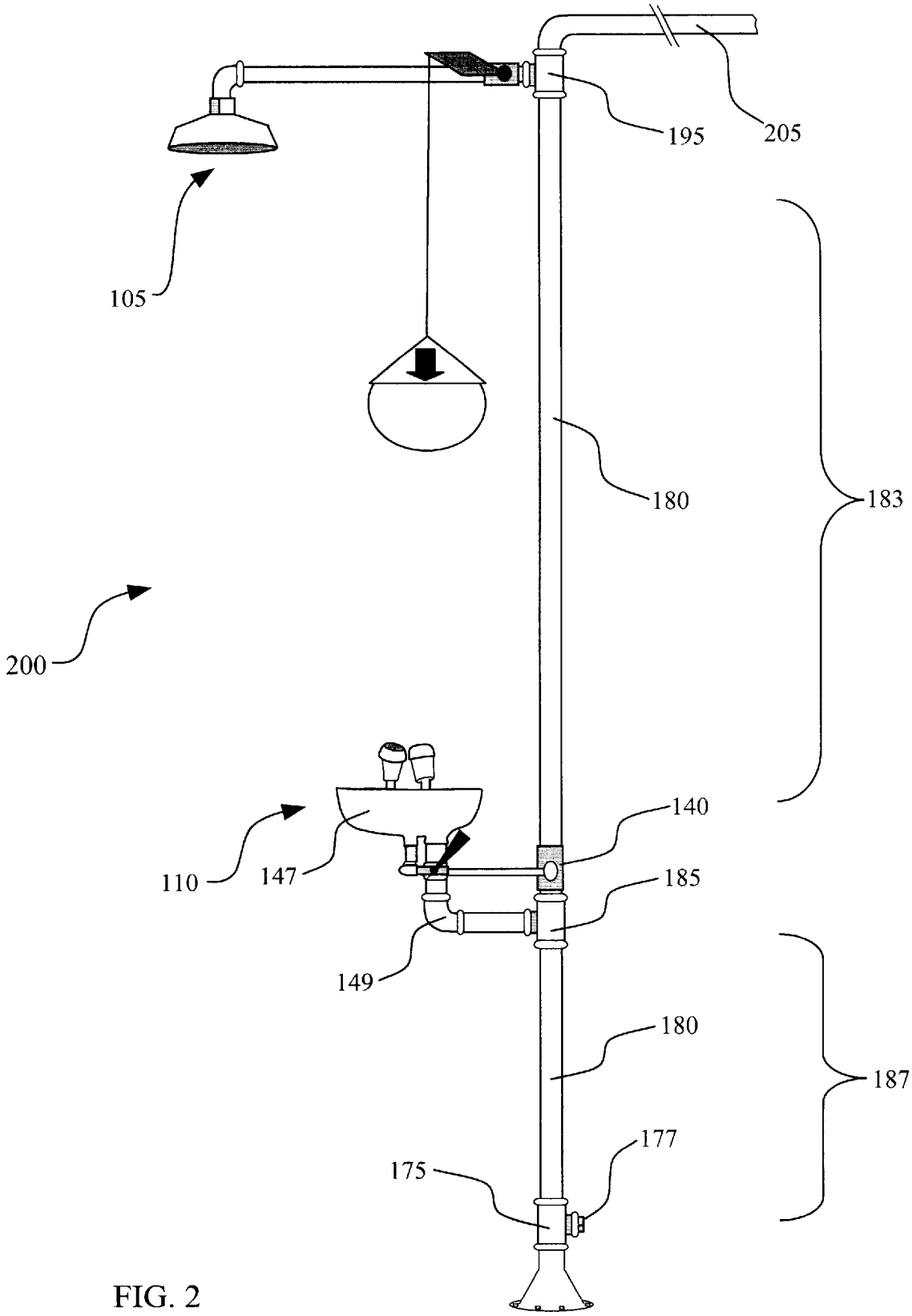
FIG. 2 (PRIOR ART)
FIG. 2 labeled as prior art, is another illustration showing alternate utility connection of the emergency shower and eye wash station shown in FIG. 1.

It should be appreciated that in the alternative to what has been explained with respect to the system 200 illustrated in FIG. 1, water could also be supplied through the second 185 or third 195 plumbing connection points. Referring to FIG. 2, also identified as prior art, facility water is provided from a water line 205 to the third plumbing connection point 195, where after it is allowed to fill the main pipe section 180. As explained with respect to FIG. 1, openings other than those associated with showerhead unit 105 and valve 125, or eyewash/facewash unit 110 and associated valve 140 should be sealed off. First plumbing connection point 175 is shown sealed off with a cap 177. It should be appreciated, however, that in a conventional system that can receive facility water as shown in FIG. 2, water can be made available to the shower head unit 105 and eyewash/facewash unit 110 through the upper portion 183 of the main pipe section 180; in which case the bowl 147 can not only be supported by the second plumbing connection point 185, but can also be allowed to drain through associated piping 149 into the lower portion 187 of the main pipe section 180 to facility waste system plumbing, which can be connected to the first plumbing connection point 175, similar to what was illustrated for receiving facility water in FIG. 1.

Figure 3:
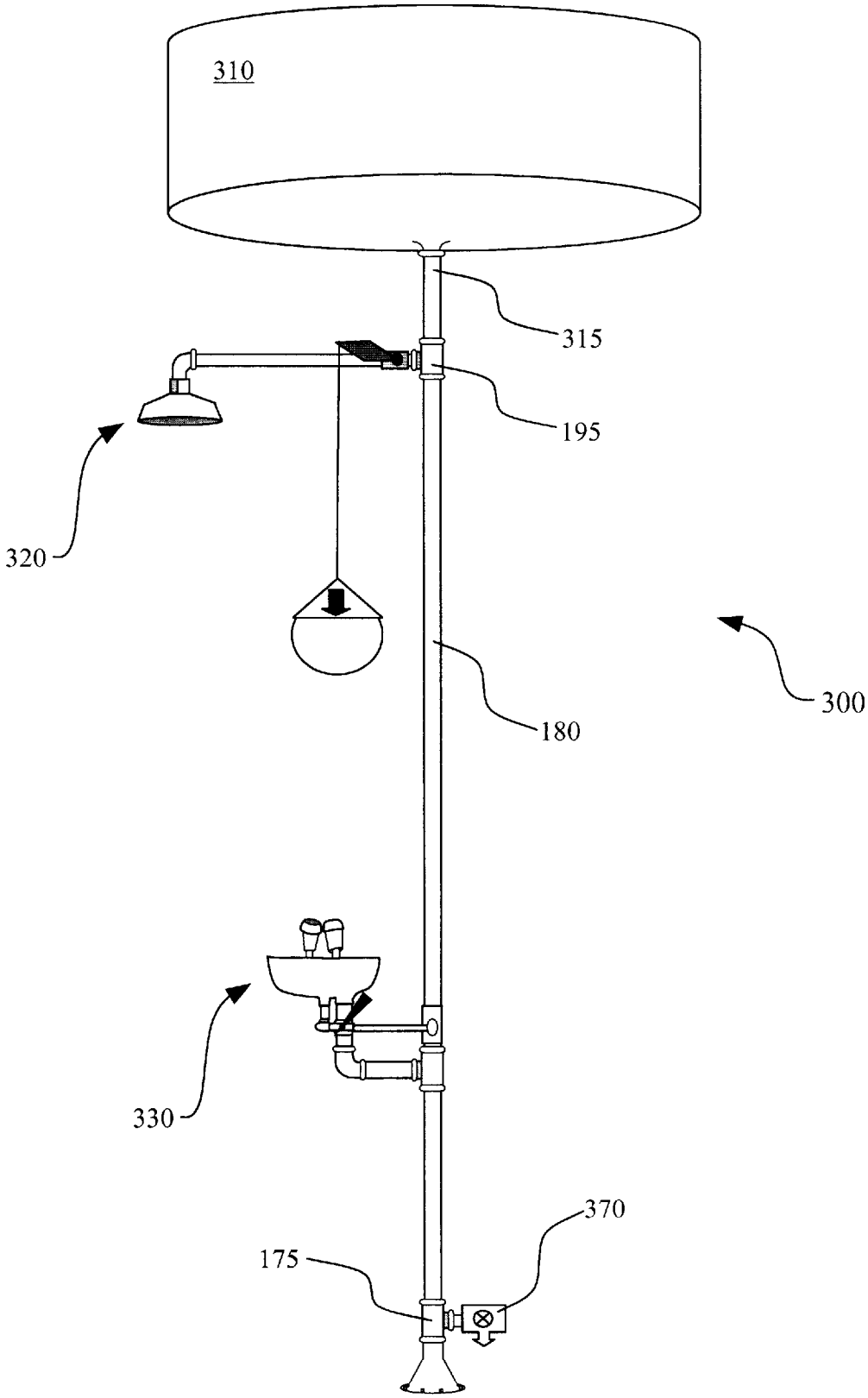
FIG. 3 illustrates a first preferred embodiment of the present invention.

Referring to FIG. 3, an emergency washing system 300 in accordance with a preferred embodiment of the present invention is illustrated. A facility or location not having access to a water source can be provided with an emergency washing system as illustrated, which includes a container 310 capable of holding large volumes of liquid an capable of being located above its connection 195 to a main pipe section 180 as described with respect to connections illustrated in FIGS. 1 and 2. A fluid release valve 370 can be provided at the first plumbing connection, selected for its location beneath washing hardware and near the ground, to allow for liquid to flow from the container 310 through the main pipe section 180 and through the release valve 370 where it can exit the system 300 during routine maintenance procedures. Otherwise a generous amount of liquid can remain on standby within the container 310 until needed by any shower 320 or eyewash/facewash hardware 330 associated with the system 300. Such a configuration ensures that fluid/water contained in the container 310 can be released after prolonged periods of non-use so that it is not allowed to itself become harmful from bacterial or microorganism growth, which is a common problem with stagnant liquid such as water.

Figure 4:
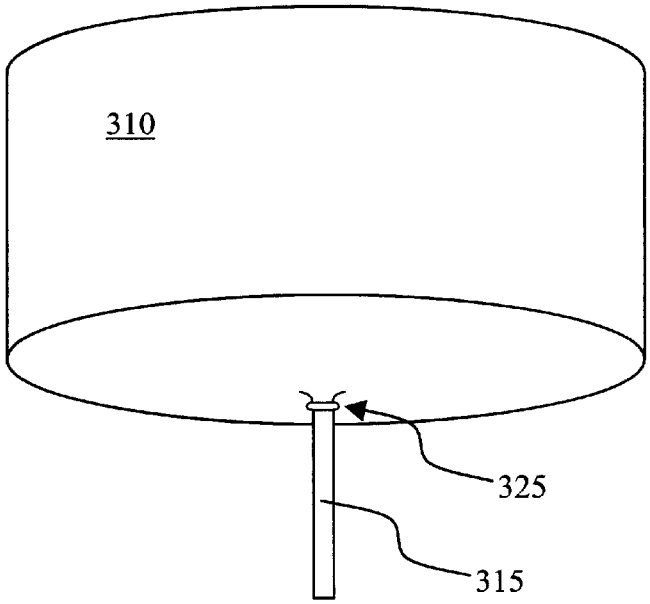
FIG. 4 illustrates an example of a container that can be used to carry out the present invention in accordance with preferred embodiment of the present invention.

Referring to FIG. 4, a close up of a container in the form of a tank is illustrated. Also shown in the FIG. 4 is the location of an exit port 325, which is where tubing 315 can be connected to tubing 315 for delivery of fluid to the tubing's connection with the third connection point 195 associated with main pipe section 180 shown in FIG. 3. A liquid storage container 310 should be selected such that it is suitable for containing a large volume (e.g., 500 to 1000 liters) of liquid. The container 310 will preferably have an opening formed near its top for receiving liquid for storage.

Figure 5:
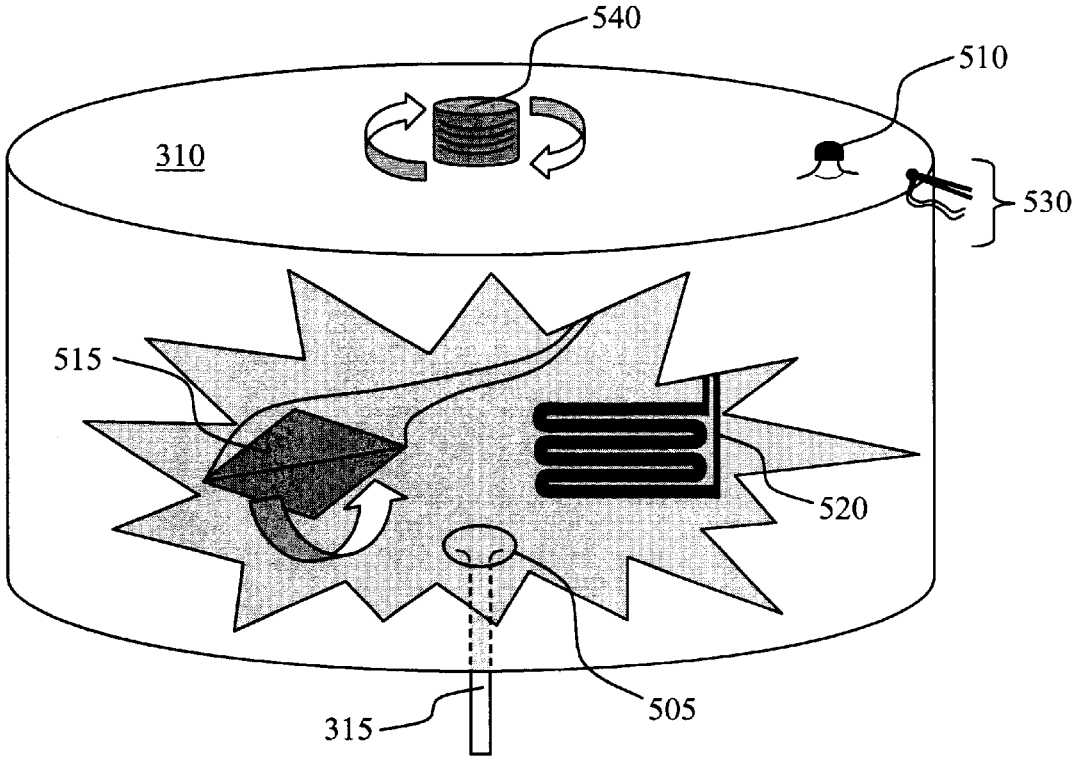
FIG. 5 illustrates additional embodiments for use with a container such as that shown in FIG. 4.

Referring to FIG. 5, the container 310 shown in FIG. 4 is now illustrated with a cutout view showing the drain 505 associated with the exit port 325 and pipe 315 connection of FIG. 4. Fluid (i.e., water) contained within the container 310 can easily flow through the drain 505, exit port 325 and any piping 315 connecting the container to conventionally installed emergency shower and eyewash using the benefit of gravity so long as the container is positioned above the location intended for the liquids end use.

A removable cover 510 should be selected for closing the opening that is formed near the top of the container 310. The cover 510, shown as a fill cap in FIG. 5, is used to refill the container 310 if it becomes low or emptied because of emergency use or during maintenance. Depending on the type of opening defined at the container's top, the cover 510 can be provided such that it adequately seals the liquid contents of the container from contaminants. Suitable covers can include lids, caps, hatches, valves and other means of providing coverage for liquid containing vessels. The liquid storage container should be located well above the emergency washing apparatus and location so that the flow of liquid from the container to the main pipe unit and attached hardware (e.g., shower head, nozzles, liquid release valves) can benefit from forces of gravity.

Also shown in FIG. 5, an air vent 540 can be added to the top of the container to allow fresh air into the tank, allowing liquid contained therein to breath. It should be appreciated that the air vent 540 can be filtered or air can be provided from an air pump, which can also be positioned in the air vent's location. An air vent 540 or air supply of another form can be useful for supplying a constant fresh air supply to the (standing) water supply. An air release valve can also be added onto the top or lid of the storage tank, in case of pressure build up where the container must be kept airtight. If the contents must remain airtight, then a release valve can be provided in the same location as air vent 540, or can be associated with cover 510.

In an effort to provide other way of preventing water stagnation within the container 310 because of storage for long duration or in warmer environments, an electromechanically driven agitation device 515 can be used inside the tank to periodically move water throughout the tank while it is being stored. In colder environments, water stagnation and spoilage is not as much of a concern. In cold weather environments, the biggest concern is over maintaining a comfortable temperature of the liquid for potential emergency users and to prevent the liquid from freezing. Water temperature can be difficult to maintain in environments lacking heat, such as outdoor facilities.

A heater 520 can be included in the container 310 to help keep the liquid contained therein at a comfortable temperature for its potential use in the event of an emergency, and to prevent the liquid from freezing. Such a heater 520 can include electrically-powered heating coils submersed in the liquid containing area of the container as shown in FIG. 5 or can be provided in the form of a heating element that is embedded in or mounted to the container's 310 housing. It should be appreciated by those skilled in the art that a heated container would benefit from insulation of some form, whether it be integrated into the container's design or installed around the external surface of the container. In cold weather environments it would be preferable that all liquid carrying piping be insulated using means know in the art. Electrical connection 530 can be located near the top of the container. It should be appreciated that the heater 520 and agitator 515 can be monitored, controlled, set and powered by computers, controllers and sources known in the art. It should also be appreciated that power can be provided to the heater 520 and agitator 515, if in use, by facility, battery and solar sources and equipment.

Figure 6:
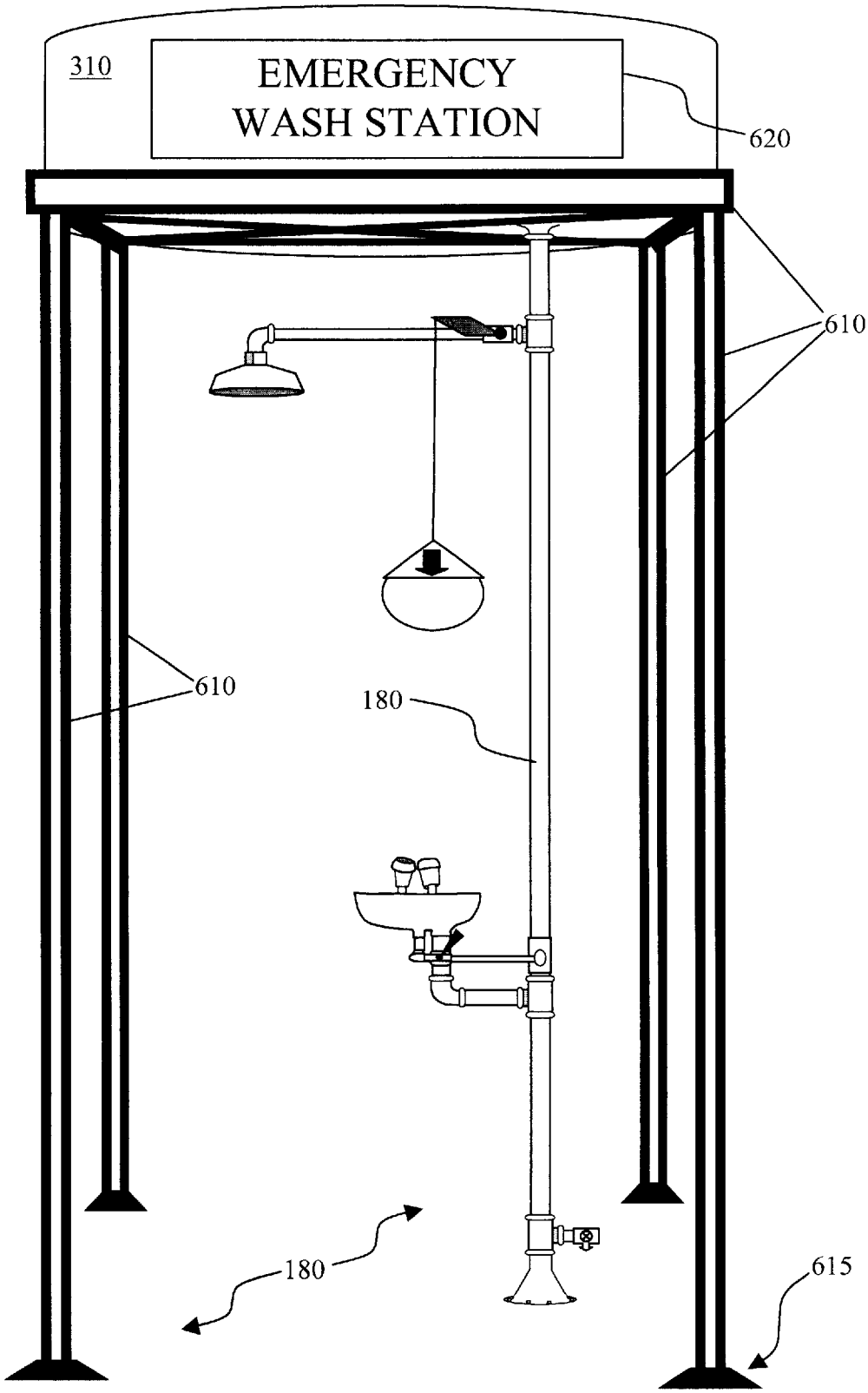
FIG. 6 illustrates additional embodiments for an emergency washing system in accordance with teachings provided herein.

It is well known in the art to also use chemical to prevent biological contamination to occur in water, and furthermore to prevent freezing of liquids. One chemical compound that will preserve water up to six months is being used throughout the world. MICROPUR™MFL 1000 (liquid) can be used as a means of preventing water contamination during storage within the container. As per the manufacture this product keeps water in tanks free from bacteria recontamination. Micropur uses bacteriostatic and bactericide properties of Silver. Unlike chlorine, which is only active in water for a few hours, silver ions can stay active for up to six months because the ions attach to cell membranes of Microorganisms, preventing their growth. Micropur's active substance is a sodium chloride complex with a 0.1 ppm silver ion content. Use of Micropur enables an effective water conservation solution that allows non-drinking water useful for emergency washing applications to be stored for up to 6 months before it must be changed out Referring to FIG. 6, the entire emergency washing system (including the hardware associated with main pipe section 180 and container 310) can include a metal rack 610 for support, identification and emergency area 180 preservation. The metal rack 610 can be secured to the floor and/or walls of a facility, or can be used in a stand-alone location where infrastructure (e.g., walls and floors capable of having equipment affixed thereto using hardware) is not available to secure or support such a system. The metal rack 610 can be supported on the ground by a base 615 associated with locations where the metal rack is placed in contact with the ground. The metal rack can also be effective in marking off the emergency stations location using signage 620 that can be affixed high above the station on the container 310. The emergency washing and decontamination area 180, which must be kept clear of machinery, hardware, personnel and other potential obstructions, can be preserved by the surrounding metal rack 610, as shown in FIG. 6. A suitable support frame can be assembled using metal or wood beams and metal nuts and bolts so that the frame can adequately support a heavy, liquid-filled container well above the emergency washing station. The support frame should also be durable enough to provide cover for the station and can also aid in proper identification of the emergency washing station's location.

The embodiments and examples set forth herein are presented to best explain the present invention and its practical application and to thereby enable those skilled in the art to make and utilize the invention. Those skilled in the art, however, should recognize that the foregoing description and examples have been presented for the purpose of illustration and example only. The description as set forth is not intended to be exhaustive or to limit the invention to the precise form disclosed. Many modifications and variations are possible in light of the above teaching without departing from the spirit and scope of the following claims.

What is claimed is:

1. An emergency washing system, comprising:

a main pipe section adapted for use as a combined vertical support and liquid delivery unit, said main pipe section extending vertically upwards about 82" or more from a base location near a floor to termination point, said main pipe support is further including a first plumbing connection point located near the floor, a second plumbing connection point located at about 33" to 45" above the floor, and a third plumbing connection point located near said termination point, wherein said plumbing connection points are adapted for receiving hardware associated with at least one of: an emergency shower unit, an emergency eye/face wash unit and liquid release valving;

a container having an opening formed near its top for receiving liquid into said container, said container further comprising a plumbed delivery port near its bottom, said plumbed delivery port for providing liquid to said main pipe section, and a removable cover, said removable cover for closing the opening formed near the top of said container, wherein said container is located substantially above said main pipe section; and a liquid release valve plumbed to said first plumbing connection point, wherein said liquid release valve can be opened to drain liquid contained in said container through said main pipe section.

2. The invention of claim 1, further comprising an emergency shower unit further comprising a shower head and associated valve assembly, said emergency shower unit in plumbed-connection to said third plumbing connection point.

3. The invention of claim 2, wherein said emergency shower unit is physically supported by its plumbed-connection to said third plumbing connection point.

4. The invention of claim 2, further comprising a support frame adapted to support said container above said emergency washing station.

5. The invention of claim 1, further comprising an emergency eye/face wash unit further comprising at least one spray head and associated valve assembly, said emergency shower unit in plumbed-connection to said second plumbing connection point.

6. The invention of claim 5, wherein said emergency eye/face wash unit is physically supported by its plumbed-connection to said second plumbing connection point.

7. The invention of claim 5, further comprising a support frame adapted to support said container above said emergency washing station.

8. The invention of claim 1, further comprising:

an emergency shower unit further comprising a shower head and associated valve assembly, said emergency shower unit in plumbed-connection to said third plumbing connection point where said emergency shower unit is also physically supported; and an emergency eye/face wash unit further comprising at least one spray head and associated valve assembly, said emergency shower unit in plumbed-connection to said second plumbing connection point where said emergency eye/face wash unit is also physically supported.

9. The invention of claim 8, further comprising a support frame adapted to support said container above said emergency washing station.

10. The invention of claim 9, wherein said support frame provides cover and identification for said emergency washing station.

11. The invention of claim 1, further comprising a support frame adapted to support said container.

12. The invention of claim 1, further comprising liquid conditioning equipment associated with said container.

13. The invention of claim 12 wherein said liquid conditioning equipment further comprises at least one of a heater and/or an agitator located inside said container.

14. The invention of claim 12, wherein power can be provided to said liquid conditioning equipment by at least one of solar equipment, batteries and a utility company.

15. An emergency washing station, comprising:

a main pipe section adapted for use as a combined vertical support and liquid delivery unit, said main pipe section extending vertically upwards about 82" or more from a base location near a floor to termination point, said main pipe support is further including a first plumbing connection point located near the floor, a second plumbing connection point located at about 33" to 45" above the floor, and a third plumbing connection point located near said termination point, wherein said plumbing connection points are adapted for receiving hardware associated with an emergency shower unit, an emergency eye/face wash unit and liquid release valving;

an emergency shower unit further comprising a shower head and associated valve assembly, said emergency shower unit in plumbed-connection to said third plumbing connection point where said emergency shower unit is also physically supported; and an emergency eye/face wash unit further comprising at least one spray head and associated valve assembly, said emergency shower unit in plumbed-connection to said second plumbing connection point where said emergency eye/face wash unit is also physically supported;

a container having an opening formed near its top for receiving liquid into said container, said container further comprising a plumbed delivery port near its bottom, said plumbed delivery port for providing liquid to said main pipe section, and a removable cover, said removable cover for closing the opening formed near the top of said liquid storage container, wherein said container is located substantially above said main pipe section; and a liquid release valve plumbed to said first plumbing connection point, wherein said liquid release valve can be opened to drain liquid contained in said container through said main pipe section.

16. The invention of claim 15, further comprising a support frame adapted to support said container above said emergency washing station.

17. The invention of claim 16, wherein said support frame provides cover and identification for said emergency washing station.

18. The invention of claim 15, further comprising liquid conditioning equipment associated with said container.

19. The invention of claim 18 wherein said liquid conditioning equipment further comprises at least one of a heater and/or an agitator located inside said container.

20. The invention of claim 18, wherein power can be provided to said liquid conditioning equipment by at least one of solar equipment, batteries and a utility company.

21. A method for providing an emergency washing station, comprising the steps of:

assembling a main pipe section adapted for use as a combined vertical support and liquid delivery unit and securing said main pipe section to a facility such that said main pipe section extends vertically upwards about 82" from the floor to termination point, and further assembling said main pipe section to include a first plumbing connection point located near the floor, a second plumbing connection point located at about 33" to 40" above the floor, and a third plumbing connection point located near said termination point, wherein said plumbing connection points can be adapted for receiving hardware associated with at least one of: an emergency shower unit, an emergency eye/face wash unit and liquid release valving;

locating a container substantially above the main pipe section, wherein said container should have an opening formed near its top that is adapted for receiving liquid into said container and a plumbed delivery port near its bottom for providing liquid to said main pipe section, and said container should include a removable cover for closing the opening formed near the top of said liquid storage container;

installing a liquid release valve to said first plumbing connection point, wherein said liquid release valve can be opened to drain liquid contained in said liquid storage container through said main pipe section;

installing an emergency shower unit in plumbed-connection to said third plumbing connection point, said emergency shower unit further comprising a shower head and associated valve assembly;

installing an emergency eye/face wash unit in plumbed-connection to said second plumbing connection point, said emergency eye/face wash unit further comprising at least one spray head and associated valve assembly; and forming a plumbed-connection between said container and said main pipe section.

22. The method of claim 21, wherein said emergency eye/face wash unit is physically supported by its plumbed-connection to said second plumbing connection point.

23. The method of claim 21, wherein said step of locating a container substantially above the main pipe section first comprises assembling a support frame adapted to support said liquid storage container.

24. The invention of claim 23, wherein said support frame is assembled in such a manner that it provides cover and identification for an emergency eye wash station.

* * * * *